US010790617B2

(12) United States Patent
Takahashi

(10) Patent No.: US 10,790,617 B2
(45) Date of Patent: Sep. 29, 2020

(54) SHIELD CONNECTOR AND SHIELD CABLE WITH TERMINAL

(71) Applicant: YAZAKI CORPORATION, Tokyo (JP)

(72) Inventor: Takakazu Takahashi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/418,936

(22) Filed: May 21, 2019

(65) Prior Publication Data

US 2019/0386435 A1 Dec. 19, 2019

(30) Foreign Application Priority Data

Jun. 19, 2018 (JP) ..... 2018-116166

(51) Int. Cl.

| | |
|---|---|
| ***H01R 9/03*** | (2006.01) |
| ***H01R 13/6474*** | (2011.01) |
| ***H01R 13/502*** | (2006.01) |
| ***H01R 13/6581*** | (2011.01) |
| ***H01R 13/6593*** | (2011.01) |

(52) U.S. Cl.

CPC ..... *H01R 13/6474* (2013.01); *H01R 13/502* (2013.01); *H01R 13/6581* (2013.01); *H01R 13/6593* (2013.01)

(58) Field of Classification Search

CPC ..... H01R 13/6474; H01R 13/502; H01R 13/6581; H01R 13/6593

USPC ..... 439/607.41–607.59

See application file for complete search history.

(56) References Cited

U.S. PATENT DOCUMENTS

| | | | | |
|---|---|---|---|---|
| 6,384,335 | B1 | 5/2002 | Saito et al. | |
| 7,232,341 | B2 * | 6/2007 | Shinmyo | H01R 13/6592 439/607.51 |
| 7,927,136 | B2 * | 4/2011 | Miyashita | H01R 9/0524 439/585 |
| 10,418,759 | B2 * | 9/2019 | Huber | H01R 24/30 |
| 2003/0049966 | A1 | 3/2003 | Yoshioka | |
| 2013/0171873 | A1 | 7/2013 | Kanda et al. | |
| 2017/0201034 | A1 | 7/2017 | Hikosaka | |
| 2018/0351305 | A1 | 12/2018 | Maesoba et al. | |
| 2019/0288456 | A1 | 9/2019 | Maesoba et al. | |

FOREIGN PATENT DOCUMENTS

| | | | |
|---|---|---|---|
| JP | 10-312857 | A | 11/1998 |
| JP | 2000-323246 | A | 11/2000 |
| JP | 2003-86308 | A | 3/2003 |
| WO | 2017/090682 | A1 | 6/2017 |
| WO | 2018/070202 | A1 | 4/2018 |

* cited by examiner

*Primary Examiner* — Khiem M Nguyen
(74) *Attorney, Agent, or Firm* — Kenealy Vaidya LLP

(57) ABSTRACT

A shield connector is mounted on a terminal of a shield cable including a conductor core wire and a shield body surrounding the conductor core wire. The shield connector includes a conductive inner terminal connected to the conductor core wire, a conductive cylindrical outer terminal connected to the shield body, and an inner housing holding the inner terminal in a hollow part of the outer terminal. A projection part is formed on an outer surface of the inner housing to maintain a distance between an outer surface of the inner terminal and an inner surface of the outer terminal at a predetermined inter-terminal distance from a tip side of the shield connector to a base end side thereof.

5 Claims, 5 Drawing Sheets

SHIELD CONNECTOR AND SHIELD CABLE WITH TERMINAL

CROSS-REFERENCE TO RELATED APPLICATIONS

This application is based on and claims priority under 35 USC 119 from Japanese Patent Application No. 2018-116166 filed on Jun. 19, 2018, the contents of which are incorporated herein by reference.

TECHNICAL FIELD

The present invention relates to a shield connector and a shield cable with a terminal in which the shield connector is mounted on the terminal of the shield cable.

BACKGROUND ART

In a related art, there is known a shield connector including an inner terminal which is connected to a counterpart terminal and conductively connected to a conductor core wire of a shield cable, a housing which accommodates and holds the inner terminal, and an outer terminal which accommodates the housing inside and is conductively connected to a shield body of the shield cable (for example, see Patent Document 1).

PRIOR ART DOCUMENT

Patent Document

Patent Document 1: JP-A-2003-086308

SUMMARY OF INVENTION

Generally, in view of a viewpoint of reducing a reflection loss caused by impedance mismatching at a connection place with a shield cable, a shield connector is designed so that characteristic impedance of the shield connector (specifically, characteristic impedance of a cylindrical structure formed by an inner terminal and an outer terminal) becomes a predetermined target value corresponding to the shield cable. Meanwhile, when a positional relationship (for example, an inter-terminal distance) between the inner terminal of the shield connector and the outer terminal thereof is changed during the transport and use of the shield connector, a shape of the above-described cylindrical structure is changed, thereby the characteristic impedance of the shield connector is also changed.

Further, from a viewpoint of improving communication quality via the shield cable on which the shield connector is mounted, it is desirable that the characteristic impedance of the shield connector (specifically, a cylindrical structure) is maintained at a designed target value as much as possible.

The present invention has been made in consideration of the above-described circumstances, and an object of the present invention is to provide a shield connector and a shield cable with a terminal capable of maintaining desirable communication quality.

In order to achieve the above-described object, a shield connector according to the present invention is characterized by the following configurations (1) to (4):

(1)

A shield connector which is mounted on a terminal of a shield cable including a conductor core wire and a shield body surrounding the conductor core wire, the shield connector including:

a conductive inner terminal which is connected to the conductor core wire;

a conductive cylindrical outer terminal which is connected to the shield body; and an inner housing holding the inner terminal in a hollow part of the outer terminal, wherein a projection part is provided on an outer surface of the inner housing to maintain a distance between an outer surface of the inner terminal and an inner surface of the outer terminal at a predetermined inter-terminal distance from a tip side of the shield connector to a base end side thereof.

(2)

The shield connector according to the configuration (1), wherein the projection part is a rib having an elongated protruding shape extending in a fitting direction of the shield connector.

(3)

The shield connector according to the configuration (1) or (2), wherein the projection part is formed to maintain the inter-terminal distance in which characteristic impedance of a cylindrical structure formed by the inner terminal and the outer terminal becomes a predetermined target value.

(4)

The shield connector according to any one of the configurations (1) to (3), further including:

an outer housing which includes a terminal accommodating chamber capable of accommodating a terminal body formed by the inner terminal, the outer terminal, and the inner housing.

According to the shield connector of the configuration (1), the inter-terminal distance between the inner terminal and the outer terminal can be maintained at the predetermined design value from the tip side of the shield connector to the base end side thereof by the projection part provided on the inner housing holding the inner terminal in the hollow part of the outer terminal. As a result, for example, the inclination of the inner terminal with respect to the outer terminal can be suppressed, thereby making it possible to suppress a variation of the characteristic impedance of the cylindrical structure formed by the inner terminal and the outer terminal. Further, a shape of the projection part is not particularly limited as long as the aforementioned inter-terminal distance can be maintained. For example, the shape thereof may be an elongated projection (a rib extending in a predetermined direction), a dot shaped projection, or a combination thereof.

Further, according to the shield connector of the above-described configuration, in comparison with a case in which the projection part is not provided on the inner housing (for example, a case in which an outer wall surface of the inner housing is in contact with the outer terminal, thereby maintaining the inter-terminal distance), since a volume of the inner housing existing in the hollow part of the outer terminal becomes small, it is possible to reduce a change in the inter-terminal distance caused by influences of thermal expansion, thermal contraction, and the like of the inner housing.

According to the shield connector of the configuration (2), the inclination, and the like of the inner terminal can be appropriately suppressed by the rib having the protruding shape extending in the fitting direction. Further, since a contact area between the inner housing and the outer terminal becomes larger than a case in which the dot shaped projection is used, a positional deviation in the fitting direction of the inner housing in the hollow part of the outer terminal can be suppressed.

According to the shield connector of the configuration (3), a shape of the projection part is designed so that the characteristic impedance of the cylindrical structure formed by the inner terminal and the outer terminal becomes the predetermined target value (for example, a design value corresponding to the shield connector). In other words, the characteristic impedance of the cylindrical structure can be arbitrarily controlled by adjusting the shape, and the like of the projection part.

According to the shield connector of the configuration (4), it is possible to improve a function as a connector by allowing the outer housing to include an engagement assurance function with a counterpart connector.

In order to achieve the above-described object, a shield cable with a terminal according to the present invention is characterized by the following configuration (5):

(5)

A shield cable with a terminal, including:

a shield cable which includes a conductor core wire and a shield body surrounding the conductor core wire; and a shield connector according to any one of the configurations (1) to (4) which is mounted on a terminal of the shield cable.

According to the shield cable with the terminal of the configuration (5), the inter-terminal distance between the inner terminal and the outer terminal can be maintained at the predetermined design value from the tip side of the shield connector to the base end side thereof by the projection part provided on the inner housing holding the inner terminal in the hollow part of the outer terminal. As a result, for example, the inclination of the inner terminal with respect to the outer terminal can be suppressed, thereby making it possible to suppress a variation of the characteristic impedance of the cylindrical structure formed by the inner terminal and the outer terminal. Further, in comparison with a case in which the projection part is not provided on the inner housing (for example, a case in which the outer wall surface of the inner housing is in contact with the outer terminal, thereby maintaining the inter-terminal distance), since the volume of the inner housing existing in the hollow part of the outer terminal becomes small, it is possible to reduce the change in the inter-terminal distance caused by the influences of the thermal expansion, the thermal contraction, and the like of the inner housing.

According to the present invention, it is possible to provide a shield connector and a shield cable with a terminal capable of maintaining desirable communication quality.

As described above, the present invention is briefly described. Further, details of the present invention will be further clarified by reading through a form (hereinafter referred to as "an embodiment") for performing the invention described hereinbelow with reference to the accompanying drawings.

DESCRIPTION OF EMBODIMENTS

Embodiment

Hereinafter, a shield cable with a terminal 2 in which a shield connector 1 is mounted on a terminal of a shield cable 70 according to an embodiment of the present invention will be described with reference to the accompanying drawings. Hereinafter, for convenience of description, in an axial direction of the shield connector 1 (a fitting direction), a side (a left side in FIGS. 1 to 3B) to which a counterpart terminal (not illustrated) is fitted is referred to as a tip side (a front side) and an opposite side thereof (a right side in FIGS. 1 to 3B) is referred as a base end side (a rear side).

Figure 1:
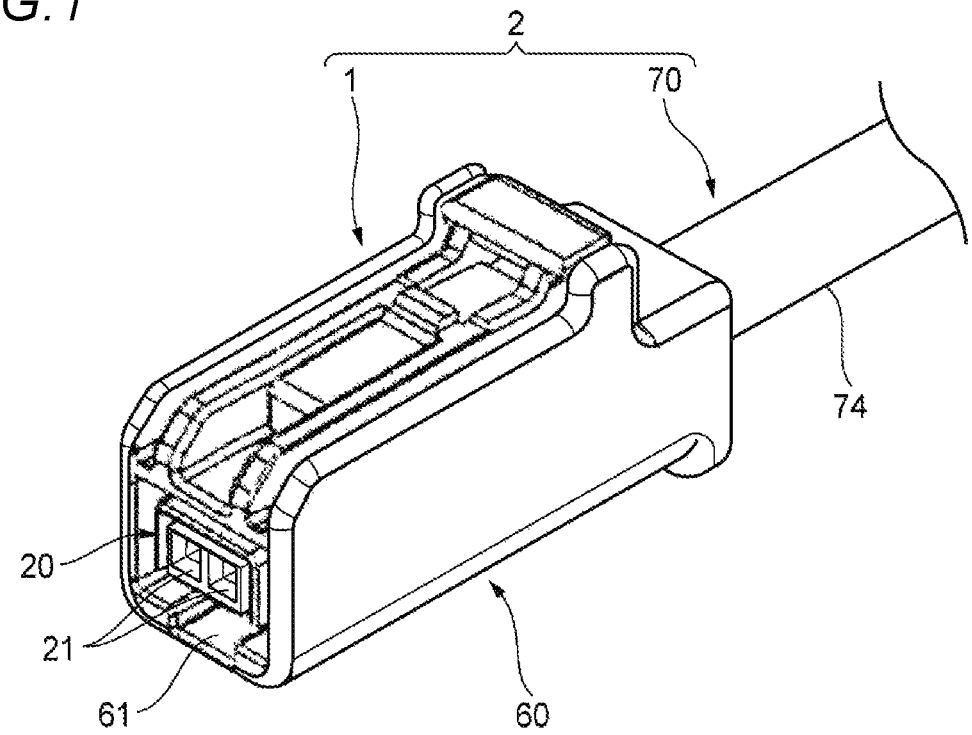
FIG. 1 is a perspective view of a shield cable with a terminal in which a shield connector is mounted on the terminal of the shield cable.
Figure 2:
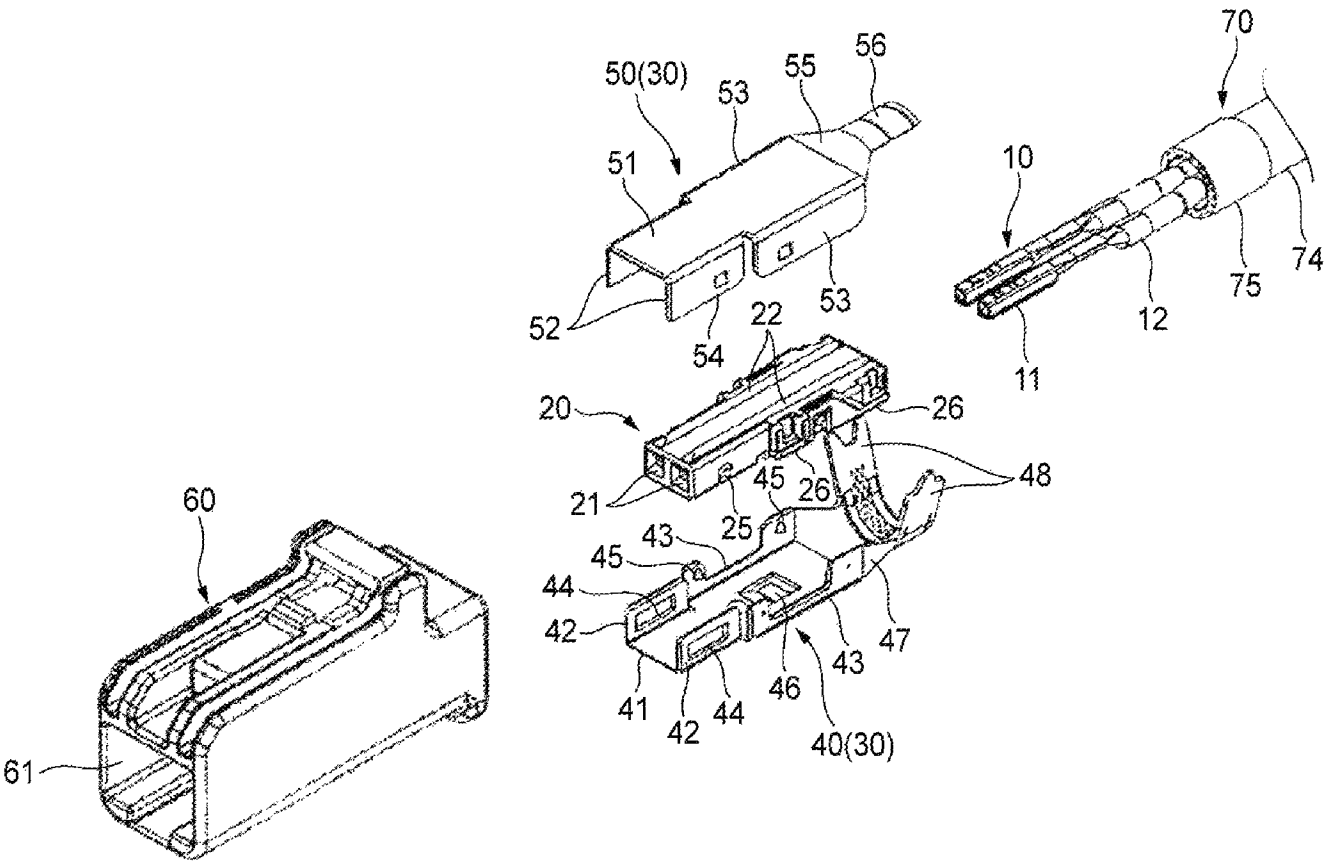
FIG. 2 is an exploded perspective view of the shield connector illustrated in FIG. 1.

As illustrated in FIGS. 1 and 2, the shield connector 1 which is mounted on the terminal of the shield cable 70 is provided with an inner terminal 10, an inner housing 20, an outer terminal 30, and an outer housing 60 (particularly, refer to FIG. 2).

As illustrated in FIGS. 2, 3A, 3B, and 5B, the shield cable 70 is formed with a plurality of electric wires 73 (two electric wires in the embodiment) which are respectively formed by a linear conductor core wire 71 and a cylindrical resin insulator 72 covering an outer periphery of the conductor core wire (particularly, refer to FIG. 5B); a cylindrical resin outer cover 74 collectively covering the plurality of electric wires 73; and a cylindrical shield body (a braid material) 75 provided on an inner peripheral surface of the outer cover 74. When the shield cable 70 is connected to the shield connector 1, a tip part of the conductor core wire 71 is exposed to the outside in advance by performing a predetermined terminal process, and a tip part of the shield body 75 is folded back to a base end side so as to cover an outer periphery of the outer cover 74 (refer to FIG. 2). Hereinafter, respective components forming the shield connector 1 will be described in order.

Figure 5A:
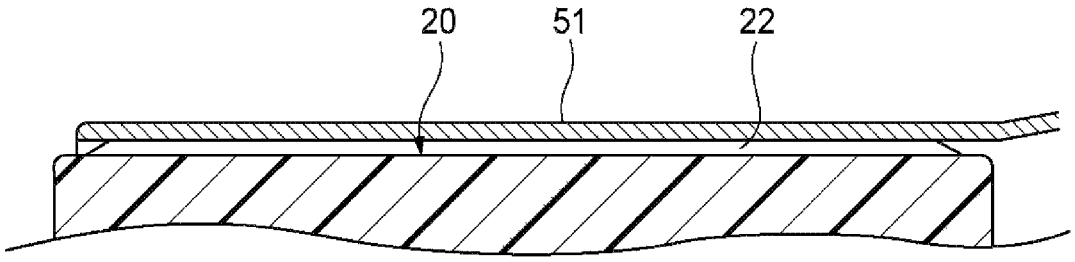
FIG. 5A is a cross sectional view taken along the B-B line of FIG. 4.
Figure 5B:
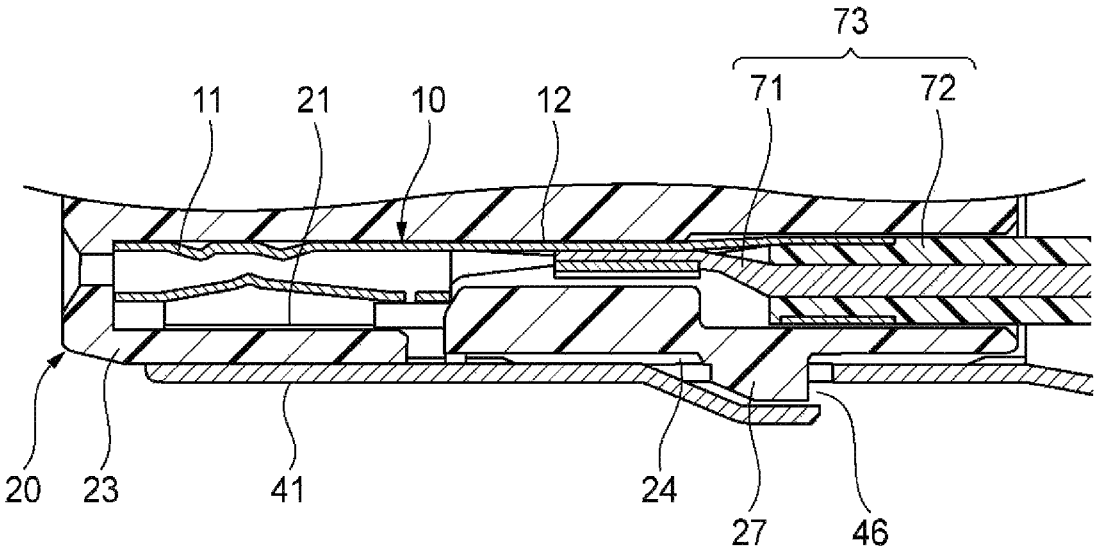
FIG. 5B is a cross sectional view taken along the C-C line of FIG. 4.

First, the inner terminal 10 will be explained. The inner terminal 10 has a function of being connected to a counterpart terminal (not illustrated) and being conductively connected to the conductor core wire 71 of the shield cable 70. As illustrated in FIGS. 2 and 5B, the inner terminal 10 which is made of metal integrally includes a rectangular cylindrical connecting part 11 which is positioned at a tip part thereof and is connected to the counterpart terminal and a pressing part 12 which is positioned at a base end part thereof and is formed by a pair of crimping pieces for pressing the conductor core wire 71 of the shield cable 70. The counterpart terminal is (a male terminal) is inserted into a hollow part (a through hole) of the connecting part 11.

Figure 3A:
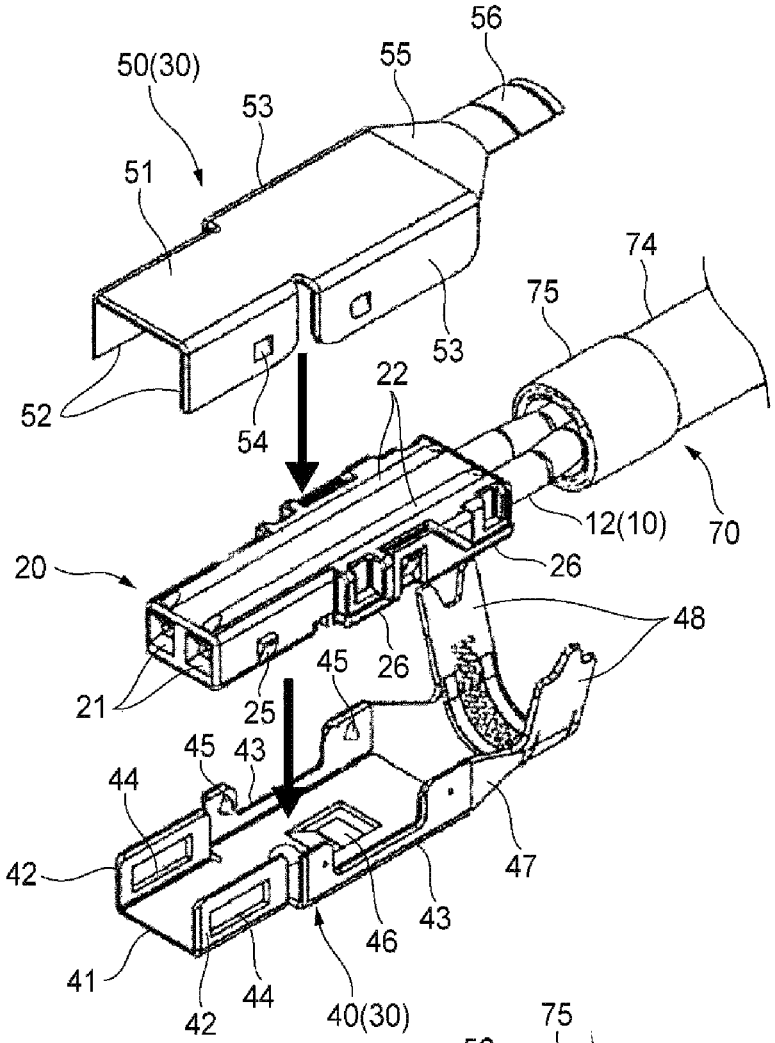
FIG. 3A is a first diagram illustrating an assembly process of the shield connector illustrated in FIG. 1.
Figure 3B:
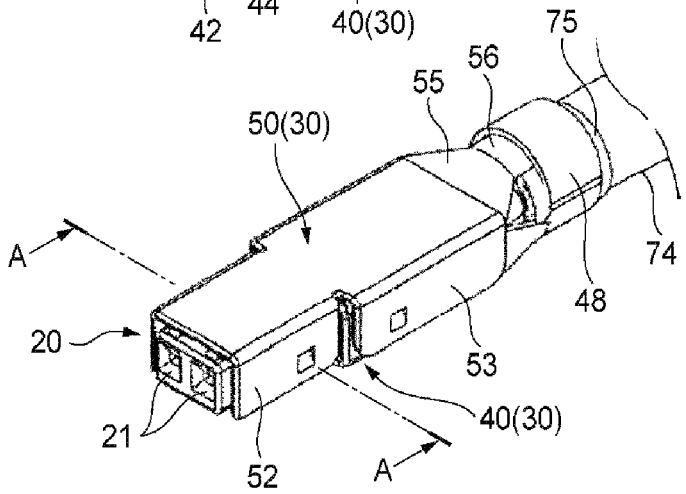
FIG. 3B is a second diagram illustrating the assembly process thereof.

Next, the inner housing 20 will be explained. The inner housing 20 accommodates and holds the connecting part 11 of the inner terminal 10, and is accommodated and held in the outer terminal 30, thereby having a function of maintaining the inner terminal 10 and the outer terminal 30 in an insulated state. As illustrated in FIGS. 2, 3A, and 3B, the inner housing 20 is made of an insulating synthetic resin having a predetermined dielectric constant and has an approximately rectangular cylindrical shape. A plurality of terminal accommodating chambers 21 (two in the embodiment) for accommodating and holding the inner terminal 10 are formed so as to be penetrated in the axial direction in the inner housing 20 (particularly, refer to FIG. 5B).

Figure 4:
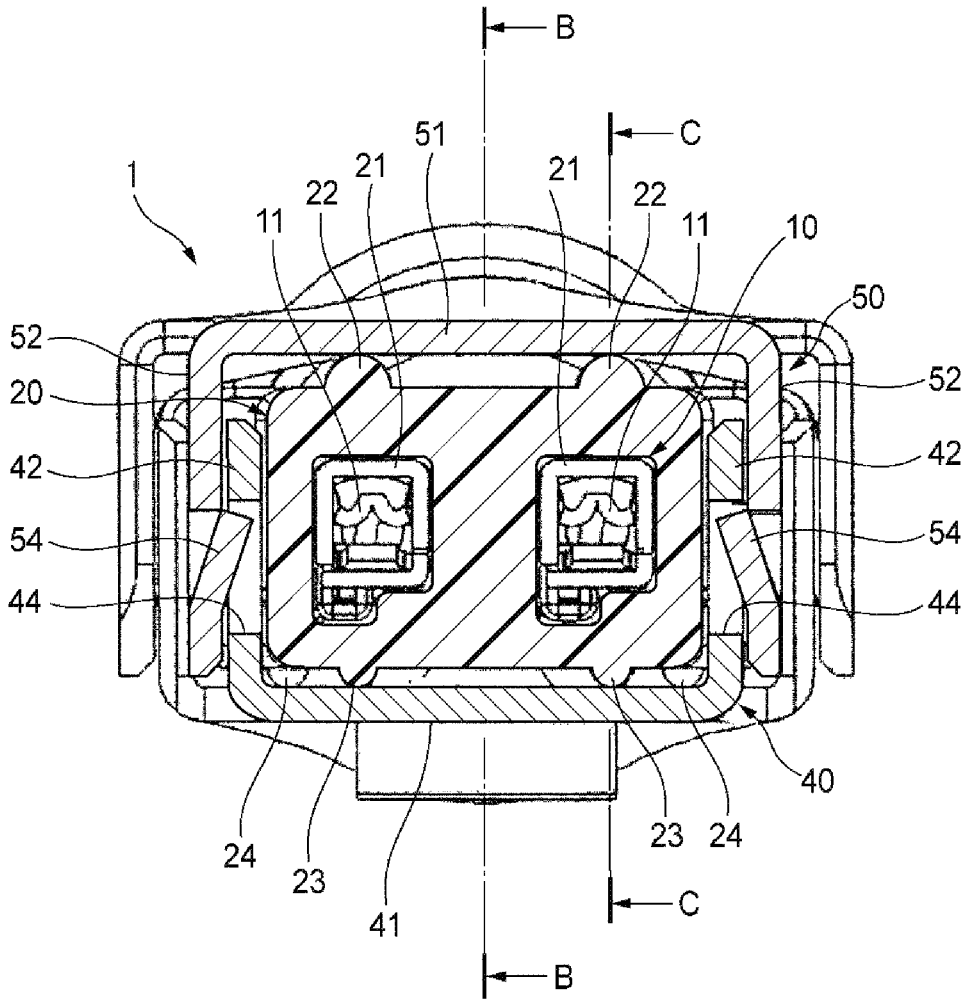
FIG. 4 is a cross sectional view taken along the A-A line of FIG. 3B.

As illustrated in FIGS. 2 to 5B, on an upper surface of the inner housing 20, a pair of ribs 22 extending in the axial direction (the fitting direction) from a tip part of the inner housing 20 to a base end part thereof are formed side by side in a width direction. As illustrated in FIGS. 4, 5A, and 5B, on a lower surface of the inner housing 20, a pair of ribs 23 extending in the axial direction over a tip side portion in the axial direction of the inner housing 20 are formed side by side in the width direction, and a pair of ribs 24 extending in the axial direction over a base end side portion in the axial direction of the inner housing 20 are formed side by side in the width direction.

The pair of ribs 23 are provided at the same width direction positions as those of the pair of ribs 22, and the pair of ribs 24 are provided at positions outside the pair of ribs 23 in the width direction. Lower end positions of the pair of ribs 23 and ribs 24 (a tip position in a protruding direction) coincide with each other. Functions of the ribs 22, 23, and 24 will be described later.

As illustrated in FIGS. 2, 3A, and 3B, a pair of projections 25 protruding in the width direction are provided at a predetermined position near the tip part on a pair of side surfaces of the inner housing 20. A pair of elongated projections 26 (in total, two pairs (four) of elongated projections 26) protruding in the width direction and extending in the axial direction are provided at respective predetermined positions of an approximately central position in the axial direction and near the base end part on the pair of side surfaces of the inner housing 20. As illustrated in FIG. 5B, a protruding part 27 protruding downward is provided at a predetermined position between the two pairs of elongated projections 26 in the axial direction on a bottom surface of the inner housing 20. Functions of the projection 25, the elongated projection 26, and the protruding part 27 will be described later.

Next, the outer terminal 30 will be described. The outer terminal 30 accommodates and holds the inner housing 20 and has a function of being conductively connected to the shield body 75 of the shield cable 70. As illustrated in FIGS. 2, 3A, and 3B, the outer terminal 30 is provided with a lower side part 40 which is made of metal and an upper side part 50 which is made of metal, and the lower side part 40 and the upper side part 50 are assembled with each other, thereby having a rectangular cylindrical shape.

The lower side part 40 is provided with a bottom plate part 41 having a flat plate shape and extending in the axial direction; a pair of first side wall parts 42 rising upward from opposite end parts in the width direction of the bottom plate part 41 over a tip side portion in the axial direction of the bottom plate part 41; a pair of second side wall parts 43 rising upward from opposite end parts in the width direction of the bottom plate part 41 over a base end side portion in the axial direction of the bottom plate part 41. The pair of second side wall parts 43 are positioned outside the pair of first side wall parts 42 in the width direction.

A pair of through holes 44 having a rectangular shape and extending in the axial direction are formed in the pair of first side wall parts 42. A pair of projections 45 (in total, two pairs (four) of projections 45) protruding inwardly in the width direction are provided on respective inner side surfaces in the width direction of opposite end parts in the axial direction of the pair of second side wall parts 43. A rectangular opening 46 is formed by providing a rectangular cut and raised part extending in a cantilever shape obliquely downward from the tip side toward the base end side at a predetermined position between the two pairs of projections 45 in the axial direction on the bottom plate part 41. When assembling the shield connector 1, the through hole 44 of the lower side part 40 and the projection 45 thereof are respectively engaged with the projection 25 of the inner housing 20 and the elongated projection 26 thereof (refer to FIG. 3A), and the protruding part 27 of the inner housing 20 is inserted into the opening 46 of the lower side part 40 (refer to FIG. 5B). A pair of crimping pieces 48 extending upward are provided to be connected on base end side end surfaces of the bottom plate part 41 and the pair of second side wall parts 43 via a connecting part 47.

The upper side part 50 is provided with a top plate part 51 having a flat plate shape extending in the axial direction; a pair of first side wall parts 52 extending downward from opposite end parts in the width direction of the top plate part 51 over a tip side portion in the axial direction of the top plate part 51; and a pair of second side wall parts 53 extending downward from opposite end parts in the width direction of the top plate part 51 over a base end side portion in the axial direction of the top plate part 51. The pair of second side wall parts 53 are positioned outside the pair of first side wall parts 52 in the width direction. When assembling the shield connector 1, the pair of first side wall parts 52 of the upper side part 50 and the pair of second side wall parts 53 thereof are brought into face-to-face contact with the pair of first side wall parts 42 of the lower side part 40 and the pair of second side wall parts 43 thereof outside in the width direction (refer to FIG. 4).

A pair of cut and raised parts 54 having a rectangular shape and extending in a cantilever shape inwardly in an oblique width direction from the lower side to the upper side are formed at a predetermined position on a base end side in the axial direction of the pair of first side wall parts 52. When assembling the shield connector 1, the cut and raised part 54 of the upper side part 50 is engaged with the through hole 44 of the lower side part 40 (refer to FIG. 4). A tongue-shaped piece 56 protruding toward the base end side is provided to be connected on a base end side end surface of the top plate part 51 via a connecting part 55.

Next, an assembly procedure of the inner terminal 10, the inner housing 20, and the outer terminal 30 (=the lower side part 40+the upper side part 50) will be described with reference to FIGS. 3A and 3B. First, as illustrated in FIG. 2, the tip parts of the plurality of conductor core wires 71 of the shield cable 70 on which the terminal process is performed are respectively pressed by the pair of crimping pieces of the pressing part 12 of the corresponding inner terminal 10.

Next, as illustrated in FIG. 3A, the plurality of inner terminals 10 to which the shield cable 70 is connected are respectively inserted into the corresponding terminal accommodating chambers 21 of the inner housing 20 from the base end side, thereby being accommodated therein.

Next, as illustrated in FIG. 3A, the inner housing 20 is assembled to the lower side part 40 so as to sandwich the inner housing 20 between the pair of first side wall parts 42 of the lower side part 40 and the pair of second side wall parts 43 thereof.

Accordingly, the pair of projections 25 of the inner housing 20 are locked to upper edges of the pair of through holes 44 of the lower side part 40, and four elongated projections 26 of the inner housing 20 are respectively locked to the four projections 45 of the lower side part 40. In addition, the protruding part 27 of the inner housing 20 is inserted into the opening 46 of the lower side part 40. As a result, as illustrated in FIGS. 4 and 5B, the pair of ribs 23 and the pair of ribs 24 positioned on the bottom surface of the inner housing 20 are maintained in a state of being in contact with the bottom plate part 41 of the lower side part 40 over the whole region in the respective axial directions, and the inner housing 20 is held so as not to be relatively moved to the lower side part 40 from the tip side to the base end side.

Next, as illustrated in FIG. 3B, the upper side part 50 is assembled to the lower side part 40 so as to respectively sandwich the pair of first side wall parts 42 of the lower side part 40 and the pair of second side wall parts 43 thereof by the pair of first side wall parts 52 of the upper side part 50 and the pair of second side wall parts 53 thereof. Accordingly, as illustrated in FIG. 4, the tip parts (upper end parts) of the pair of cut and raised parts 54 of the upper side part 50 are locked to the upper edges of the pair of through holes 44 of the lower side part 40 (refer to FIG. 4). In this state, the pair of crimping pieces 48 of the lower side part 40 are positioned on a lower side of the folded-back part of the shield body 75 of the shield cable 70, and the tongue-shaped piece 56 of the upper side part 50 is positioned on an upper side of the folded-back part of the shield body 75.

Next, as illustrated in FIG. 3B, the pair of crimping pieces 48 of the lower side part 40 are pressed and fixed so as to collectively cover the folded-back part of the shield body 75 of the shield cable 70 and the tongue-shaped piece 56 of the upper side part 50. As a result, as illustrated in FIGS. 4 and 5A, the pair of ribs 22 positioned on the upper surface of the inner housing 20 are maintained in a state of being in contact with the top plate part 51 of the upper side part 50 over the whole region in the respective axial directions, and the lower side part 40 and the upper side part 50 are held so as not to be relatively moved to each other.

As described above, the assembly of the inner terminal 10, the inner housing 20, and the outer terminal 30 (=the lower side part 40+the upper side part 50) is completed (refer to FIG. 3B). In this state, as described above, the pair of ribs 23 and the pair of ribs 24 positioned on the bottom surface of the inner housing 20 are maintained in the state of being in contact with the bottom plate part 41 of the lower side part 40 over the whole region in the respective axial directions, and the pair of ribs 22 positioned on the upper surface of the inner housing 20 are maintained in the state of being in contact with the top plate part 51 of the upper side part 50 over the whole region in the respective axial directions, whereby a distance between an outer surface of the inner terminal 10 and an inner surface of the outer terminal 30 (=the lower side part 40+the upper side part 50) is maintained at a predetermined inter-terminal distance from the tip side to the base end side.

Accordingly, the outer terminal 30 (refer to FIG. 3B) in which the inner terminal 10 and the inner housing 20 are held is accommodated and fixed in the terminal housing chamber 61 of the outer housing 60 as illustrated in FIG. 1. As described above, the assembly of the shield connector 1 is completed. As a result, the shield cable with the terminal 2 in which the shield connector 1 is mounted on the terminal of the shield cable 70 is obtained (refer to FIG. 1).

As described above, according to the shield connector 1 and the shield cable with the terminal 2 according to the embodiment of the present invention, the inter-terminal distance between the inner terminal 10 and the outer terminal 30 can be maintained at a predetermined design value from the tip side of the shield connector 1 to the base end side thereof by the ribs 22, 23, and 24 provided on the inner housing 20 for holding the inner terminal 10 in a hollow part of the outer terminal 30. As a result, inclination of the inner terminal 10 with respect to the outer terminal 30 can be suppressed, thereby making it possible to suppress a variation of characteristic impedance of a cylindrical structure formed by the inner terminal 10 and the outer terminal 30. Further, in comparison with a case in which the projection is not provided on the inner housing 20, and the outer wall surface of the inner housing 20 is in contact with the outer terminal 30, thereby maintaining the inter-terminal distance, a degree of the inclination of the inner terminal 10 with respect to the outer terminal 30 caused by influences of thermal expansion, thermal contraction, and the like of the inner housing 20 during the use of the shield connector 1 is considered to become small.

Further, since the ribs 22, 23, and 24 have elongated protruding shapes extending in the fitting direction, the inclination of the inner terminal 10 in the fitting direction can be appropriately suppressed.

Further, the shapes of the ribs 22, 23, and 24 are designed so that the characteristic impedance of the cylindrical structure formed by the inner terminal 10 and the outer terminal 30 becomes a predetermined target value. In other words, it is possible to arbitrarily control the characteristic impedance of the cylindrical structure.

Other Embodiments

Further, the present invention is not limited to each embodiment described above, and various modifications can be adopted within the scope of the present invention. For example, the present invention is not limited to the above-described embodiment, but can be appropriately modified, improved, and the like. In addition, the material, shape, dimension, number, arrangement place, and the like of each component in the above-described embodiment are arbitrary and not limited thereto as long as the present invention can be achieved.

In the embodiment, as the "projection part", the ribs 22, 23, and 24 having the elongated protruding shapes and extending in the fitting direction are adopted, however, alternatively, for example, a number of projections protruding in a dot shape may be adopted as the "projection part".

Here, the characteristics of the embodiments of the shield connector 1 and the shield cable with the terminal 2 according to the present invention described above are briefly summarized in the respective following (1) to (5):

(1)

A shield connector (1) which is mounted on a terminal of a shield cable (70) including a conductor core wire (71) and a shield body (75) surrounding the conductor core wire (71), the shield connector (1) including:

a conductive inner terminal (10) which is connected to the conductor core wire (71);

a conductive cylindrical outer terminal (30, 40, 50) which is connected to the shield body (75); and an inner housing (20) holding the inner terminal (10) in a hollow part of the outer terminal (30, 40, 50), wherein a projection part (22, 23, 24) is provided on an outer surface of the inner housing (20) to maintain a distance between an outer surface of the inner terminal (10) and an inner surface of the outer terminal (30) at a predetermined inter-terminal distance from a tip side of the shield connector (1) to a base end side thereof.

(2)

The shield connector (1) according to the configuration (1), wherein the projection parts are ribs (22, 23, and 24) having elongated protruding shapes extending in a fitting direction of the shield connector (1).

(3)

The shield connector (1) according to the configuration (1) or (2), wherein the projection parts (22, 23, and 24) are formed to maintain the inter-terminal distance in which characteristic impedance of a cylindrical structure formed by the inner terminal (10) and the outer terminal (30) becomes a predetermined target value.

(4)

The shield connector (1) according to any one of the configurations (1) to (3), further including:

an outer housing (60) which includes a terminal accommodating chamber (61) capable of accommodating a terminal body formed by the inner terminal (10), the outer terminal (30), and the inner housing (20).

(5)

A shield cable with a terminal (2), including:

a shield cable (70) which includes a conductor core wire (71) and a shield body (75) surrounding the conductor core wire (71); and a shield connector (1) according to any one of the configurations (1) to (4) which is mounted on a terminal of the shield cable (70).

What is claimed is:

1. A shield connector which is mounted on a terminal of a shield cable including a conductor core wire and a shield body surrounding the conductor core wire, the shield connector comprising:

a conductive inner terminal which is connected to the conductor core wire;

a conductive cylindrical outer terminal which is connected to the shield body; and an inner housing which holds the inner terminal in a hollow part of the outer terminal, wherein a projection part is provided on an outer surface of the inner housing to maintain a distance between an outer surface of the inner terminal and an inner surface of the outer terminal at a predetermined inter-terminal distance from a tip side of the shield connector to a base end side thereof.

2. The shield connector according to claim 1, wherein the projection part is a rib having an elongated protruding shape extending in a fitting direction of the shield connector.

3. The shield connector according to claim 1, wherein the projection part is formed to maintain the inter-terminal distance in which characteristic impedance of a cylindrical structure formed by the inner terminal and the outer terminal becomes a predetermined target value.

4. The shield connector according to claim 1, further comprising an outer housing which includes a terminal accommodating chamber capable of accommodating a terminal body having the inner terminal, the outer terminal, and the inner housing.

5. A shield cable with a terminal comprising:

a shield cable which includes a conductor core wire and a shield body surrounding the conductor core wire; and a shield connector according to claim 1 which is mounted on a terminal of the shield cable.

* * * * *